US005522336A

United States Patent [19]

Fujita

[11] Patent Number: 5,522,336

[45] Date of Patent: Jun. 4, 1996

[54] METHOD AND SYSTEM FOR THE CASTING OF ANCHORS AND MOORING OF PLATFORMS AND ANCHOR CASTING UNIT FOR SAME

[75] Inventor: Tokume Fujita, Rio de Janeiro, Brazil

[73] Assignee: Petroleo Brasileiro S.A., Rio de Janeiro, Brazil

[21] Appl. No.: 217,213

[22] Filed: Mar. 24, 1994

Related U.S. Application Data

[63] Continuation of Ser. No. 927,736, Aug. 12, 1992, abandoned, which is a continuation of Ser. No. 640,730, Jan. 14, 1991, abandoned.

[30] Foreign Application Priority Data

Jan. 15, 1990 [BR] Brazil ..... 9000135

[51] Int. Cl.[6] ..... B63B 21/00

[52] U.S. Cl. ..... 114/293; 114/230

[58] Field of Search ..... 114/230, 264, 114/274, 293; 405/195, 244; 441/1, 3, 6

[56] References Cited

U.S. PATENT DOCUMENTS

| | | | |
|---|---|---|---|
| 3,967,572 | 7/1976 | Lea | 114/230 |
| 3,985,093 | 10/1976 | Eidem | 114/230 |
| 4,430,023 | 2/1984 | Hayes | 114/293 |
| 4,476,801 | 10/1984 | Foster | 114/293 |
| 4,509,448 | 4/1985 | Pease | 114/293 |
| 4,513,681 | 4/1985 | Crook | 114/293 |
| 4,722,293 | 2/1988 | Foster | 114/230 |
| 4,841,898 | 6/1989 | Ballantyne | 114/293 |
| 4,878,452 | 11/1989 | Regan | 114/293 |
| 4,889,065 | 12/1989 | van den Haak | 114/293 |

*Primary Examiner*—Robert J. Oberleitner
*Assistant Examiner*—C. J. Bartz
*Attorney, Agent, or Firm*—Sughrue, Mion, Zinn, Macpeak & Seas

[57] ABSTRACT

A system for the casting of anchors meant for the mooring of floating oil producing and/or drilling platforms, using an anchor laying craft. The general arrangement consists of a deck on the craft with wells for anchors a capstant for dealing with chains, an improved drums for wire rope, and lockers for stowing of chains built into the underside of the deck of the craft. Chains are led by a capstan from such lockers or back to them, along hawse pipes, and drums for winding cables, mounted on a bed. When a platform is being moored, an improved laying device is used which prevents any chain slipping or dropping after each platform chain has been fastened to the line laid beforehand whenever the chain has to be lowered to its place in the sag, and an improved line fisher.

4 Claims, 14 Drawing Sheets

FIG. 11
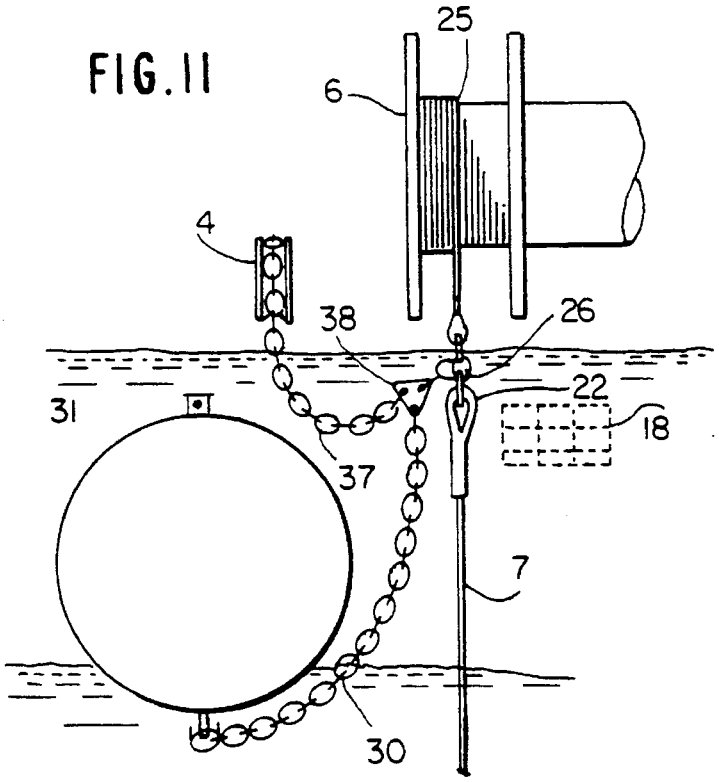
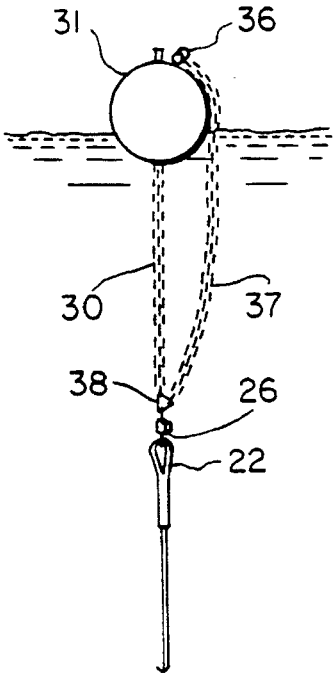
FIG. 12
FIG. 13A
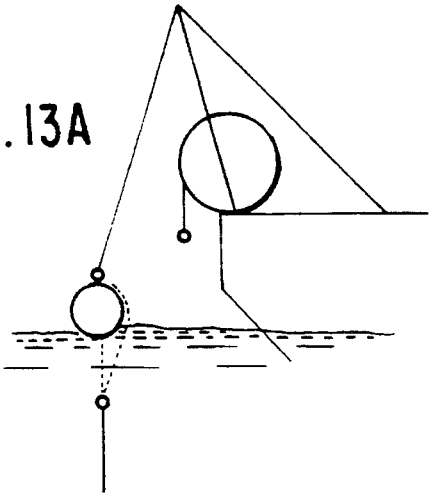
FIG. 13B
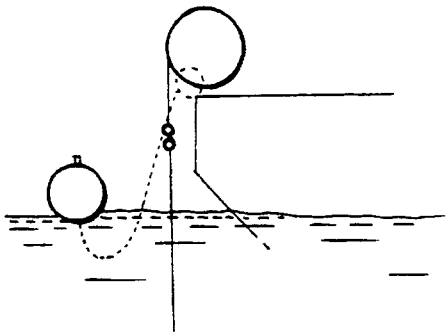

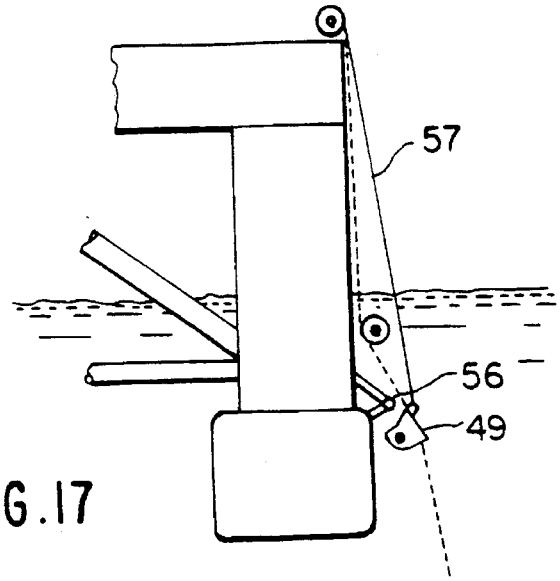
FIG.17
FIG.18A
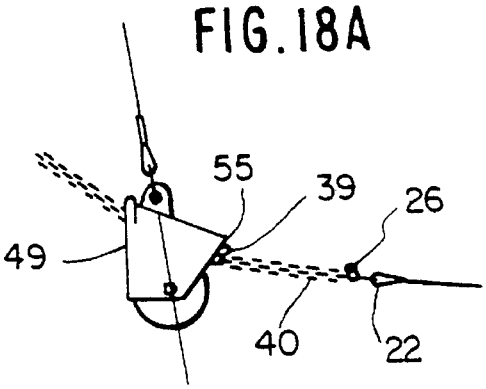
FIG.18B
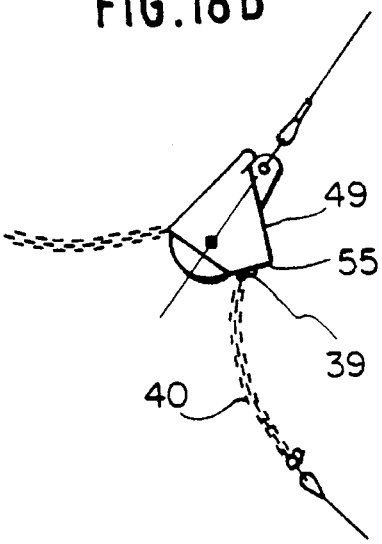

METHOD AND SYSTEM FOR THE CASTING OF ANCHORS AND MOORING OF PLATFORMS AND ANCHOR CASTING UNIT FOR SAME

CROSS REFERENCE TO RELATED APPLICATIONS

The present application is a continuation of application Ser. No. 07/927,736 filed Aug. 12, 1992, now abandoned, which is a continuation of application Ser. No. 07/640,730 filed Jan. 14, 1991 and now abandoned.

FIELD OF THE INVENTION

This invention concerns a method and system for the casting of anchors intended to moor floating drilling and producing oil rigs, for which an anchor casting unit is used that is specially designed to store all the material usually kept on the platform for such purpose such unit being equipped to enable anchors and wire ropes to be cast beforehand continuously, line tautness tests to be carried out and ropes to be fastened to platform chains when the latter is positioned.

DESCRIPTION OF THE PRIOR ART

A conventional method of mooring floating offshore drilling and production platforms, particularly when intended for use in deep waters, consists of a combination of chains and large gauge wire ropes, which means that platforms must be provided with storage space and heavy-lift cranes to handle them. Usually eight mooring lines at least are needed, and two main winches are needed for each mooring line. Some examples of systems most used are described in the specifications of patents; FR 2208373, U.S. Pat. Nos. 3,985,093, 3,967,572 and 4,722,293.

Though the most optimized of known systems is the one described above, they have one very great defect when they are used for production platforms.

Once a production platform has been put into place it will not be moved again for the next 10 or 15 years, which means that such equipment is hardly being used at all and very occasionally at that, rendering it therefore highly expensive. To this fact must be added the drop in cargo carrying capacity, loss of deck space, loss of compartment room, etc., amongst other things.

In the conventional system, the chains, wire ropes and anchors are stored on board the platform and are dropped by transferring the anchor already fastened to its chain into a special kind of tug, with the aid of a device known as an anchor chaser tied to a tug hawser. After such transfer the tug travels away from the platform to wherever it has been agreed upon beforehand that the anchor is to be dropped, and towing the chain that the windlass on the platform has released.

After an agreed upon length of chain has been paid out and if the system is not of the continuous kind, the chain is tied to the steel rope (on the platform) and job goes ahead, this time with the aid of the capstan for the wire rope, whereupon at the spot where the anchor is to take hold it is lowered and the chaser retrieved. To do this a very strong tug, able to make its way against the weight of the anchor and the sag of the wire rope and chain is needed.

A big disadvantage of this system it that production platforms lie moored by their wire ropes, which are more prone to wear, fatigue and corrosion than the chains, and particularly at the parts that pass through fairleads and the splash zone where waves and the salt sea air do the most harm, thus calling for greater maintenance or more frequent replacement thereof.

For drilling platforms, this kind of trouble is not so bad since such kinds of platforms are shifted from place to place more frequently, the parts referred to above thus lying in different spots, even in waters of like depth.

Practice has served to show that the ideal minimum requirements to keep a production rig in place consists of—in sequence from the sea bottom upwards—an anchor, a first length of chain, an intermediate length of wire rope, a second length of chain, a fairlead, a windlass, and a locker for the second length of chain. The foremost advantage of this system is that the platform is moored by the chain instead of by the wire rope, as in the conventional system, and therefore corrosion and metal fatigue troubles are cut down.

However to put this system into effect meant having to overcome the question of casting anchors, for which the conventional methods could not be employed; and all answers devised to date have turned out to be extremely costly and complicated.

This invention aims to produce an answer to such question.

SUMMARY OF THE INVENTION

The aim of this invention is to provide an anchor-casting craft able to store all the gear needed to cast the anchors and which are to be taken off the platform deck; such craft being equipped to enable all of the anchors, chains and wire ropes to be cast overboard beforehand and lines tested for pull, and afterwards, wire ropes to be fastened to production or drilling platform chains, upon bringing such platform into place.

General arrangement of the casting craft of this invention is one having a deck provided with anchor wells, a capstan to deal with chains, suitable wire rope drums, lockers to stow chains, built into the underside of the deck, which chains are led to the capstan or back to the lockers by means of hawsepipes, and drums to stow wire rope, all mounted on suitable beds.

Another purpose of this invention is to provide a swift and efficient anchor dropping system with the casting craft, along with the improved kind of drums for the wire mooring rope capstan.

A further purpose of this invention is to provide a platform mooring system which employs an improved dropping device which prevents any slipping or falling after platform chain has been tied to a line already dropped, whenever the same have to be lowered down to sag level, and also an improved line fishing tool.

Further purposes, features and advantages of this invention will be easier to follow from the detailed description thereof given below, along with the Figures that are part of this specification.

BRIEF DESCRIPTION OF THE DRAWINGS

FIGS. 6A–6H, 7, 8, 9, 10, 11, 12 are schematic views in sequence of the anchor dropping stages of this invention.

FIGS. 13A–13H are views of the stages of the platform mooring system.

FIG. 17 is a schematic view showing how the improved line fishing tool on the platform is installed.

FIGS. 18A–18D are views showing how the improved line fishing tool works.

DETAILED DESCRIPTION OF THE INVENTION

This invention consists of a specially designed anchor dropping craft meant for use in the mooring of floating production or drilling rigs, and which is able to carry all the gear usually stowed and carried on board such rig platforms. The craft is equipped so as to enable anchors, chains and wire ropes to be cast overboard beforehand, and lines tested for pull, and then afterwards such wire rope is fastened to the producing or drilling platform chains when such platforms are being brought into place.

Figure 1:
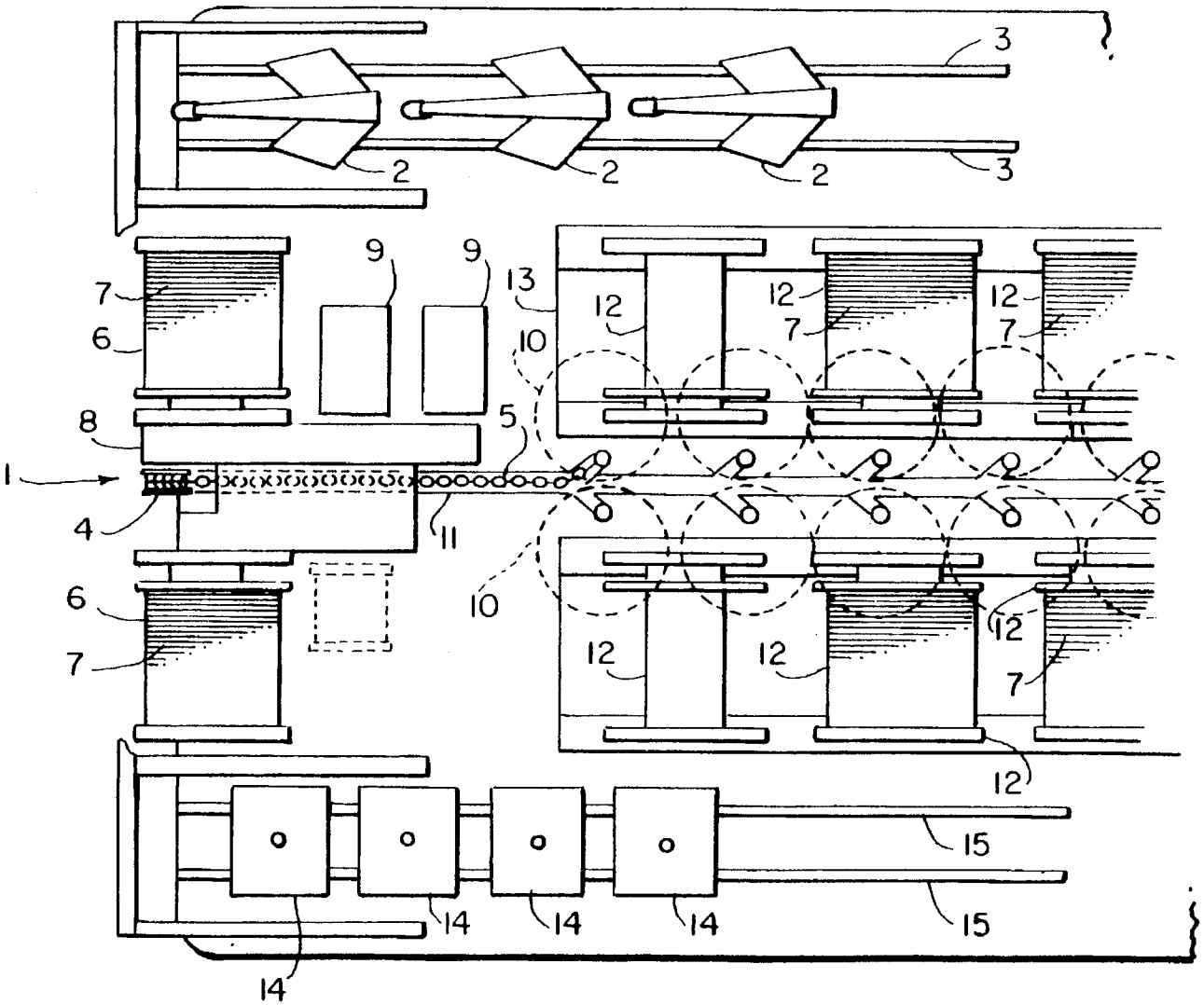
FIG. 1 is a plan view of the general layout of the deck of the anchor-dropping craft of this invention.

FIG. 1 represents the general layout of the deck of such dropping craft, referred to as 1, on which anchors, referred to as 2, in their wells, 3, are shown, plus capstan, 4, for chains, 5, and two improved kinds of drums, 6, for steel rope, 7, operated by drive, 8, from motors, 9. Chains, 5, are stowed in lockers, 10, built into the underside of the deck of the craft, and are led to the capstan, 4, or back to the lockers, 10, along hawsepipes, 11, which may be done under power to make return into lockers easier. Wire rope, 7, is wound on stowage drums, 12, mounted on a bed, 13, which drums are provided with devices, also power-driven, and brakes and fairleads (not shown in FIG. 1), to enable rope 7, wound on the improved drums, 6, of capstans, 4, to be paid out when casting, and the opposite, when mooring ropes are being brought in or exchanged.

The capacity of the improved drums, 6 and of the stowage drums, 12, is high, though practical and economical enough to enable long stretches of rope to be laid, though even greater lengths may be laid if joined together.

The chief buoys, 14, lie in their housing, 15, and the smaller size and weight lesser buoys, anchors and anchor weights can be left on deck, within cribs or special beds. In order to make it easier to shift such gear on deck a mobile track-laying crane may be provided.

Figure 2:
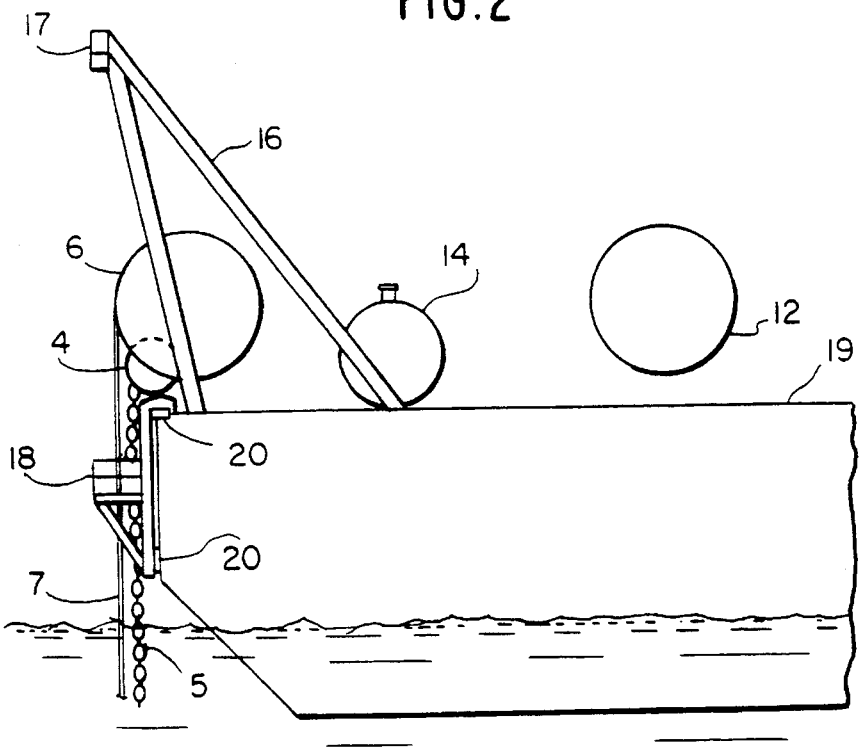
FIG. 2 is a side view of a platform standing aft of the craft.

As is to be seen from FIG. 2, a frame, 16, bears a full-length girder along which any sheaves and running tackle needed are provided.

Platform, 18, mounted aft of the craft, 19, runs on rails, 20, and is powered to enable it to take up any position along the stern of the craft, whenever rope and chains are being fastened or unfastened, and platform may be provided with wedges for the chains and wire rope to help operations.

The foregoing descriptions, provided in terms of FIGS. 1 and 2, are of a version of the invention, which is installed on the deck of a float since the width thereof enables the layout outlined to be adopted, thus rendering operations easier, but any other kind of craft could have been employed.

The main advantage of this answer is that existing rafts can be put to use, subject to a few modifications, while the cost of any such changes, including cost of the windlass and other fixtures, should be less than the amount saved in the building of an individual semi-submersible production platform, if the fact be taken into account that the intended system means that eight stowage capstans and eight wire rope winding capstans will not be needed on board.

In addition to dealing with the mooring of other like kinds of platforms, other advantages provided thereby consist of:

a) being able to operate continuously with having to return to base to refuel;

b) pulling tests on lines laid can be carried out;

c) inspection and/or replacemnt of mooring lines can be undertaken;

d) enables piggybacks and intermediary buoys to be used for the lines;

e) ordinary tugs can be used;

f) use of the craft itself for hauling and stowage purposes, loading it at regular wharfs or those belonging to factories, usually provided with cargo handling facilities, thereby doing away with the need for handling gear and equipment which would otherwise be needed at the supply base, since because made to order items are involved, the group in charge of operations cannot do without a suitable stock thereof.

Figure 3:
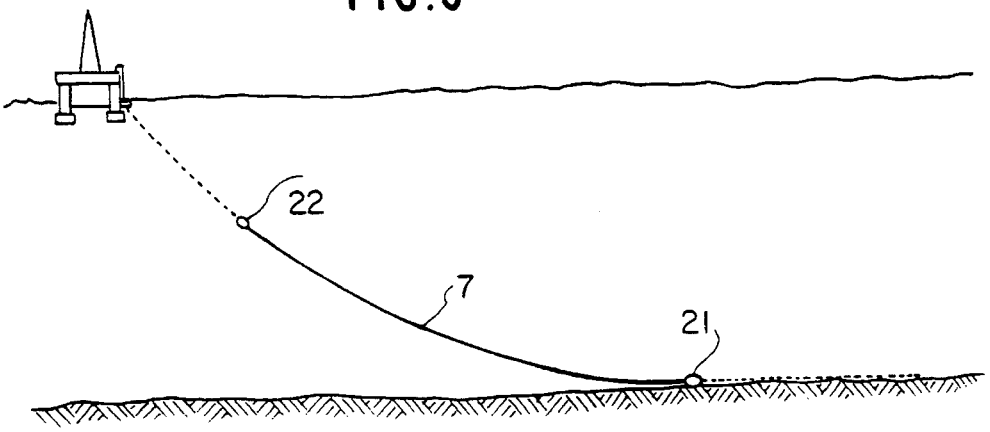
FIG. 3 is a side view showing a mooring line, the middle of which consists of a wire rope with two loops at either end for fastening to the two lengths of chain or to standby buoy.

In FIG. 3 the wire rope lying in the middle of the mooring line is provided with loops, 21 and 22, at either end thereof, for fastening to the two lengths of chain or to a standby buoy, as will be explained further on when dealing with the anchor dropping system.

After wire rope, 7, has been laid, and which had until then been wound on the capstan drum, loop 22 should lie on the working platform aft of the craft, waiting to be fastened later on. Placing of such loop, 22, cannot however be done with the aid of an extension to the wire rope (for instance, a smaller gauge one), since dimensions not only of the loops but also of the fastening accessories lying on the first few turns of wire on the drum when being wound, are of a given size, and this would lead not only to the turns thereafter being unevenly wound but also, worse still, to damage brought about by squeezing and twisting, which is fatal to the life of wire ropes.

Figure 4:
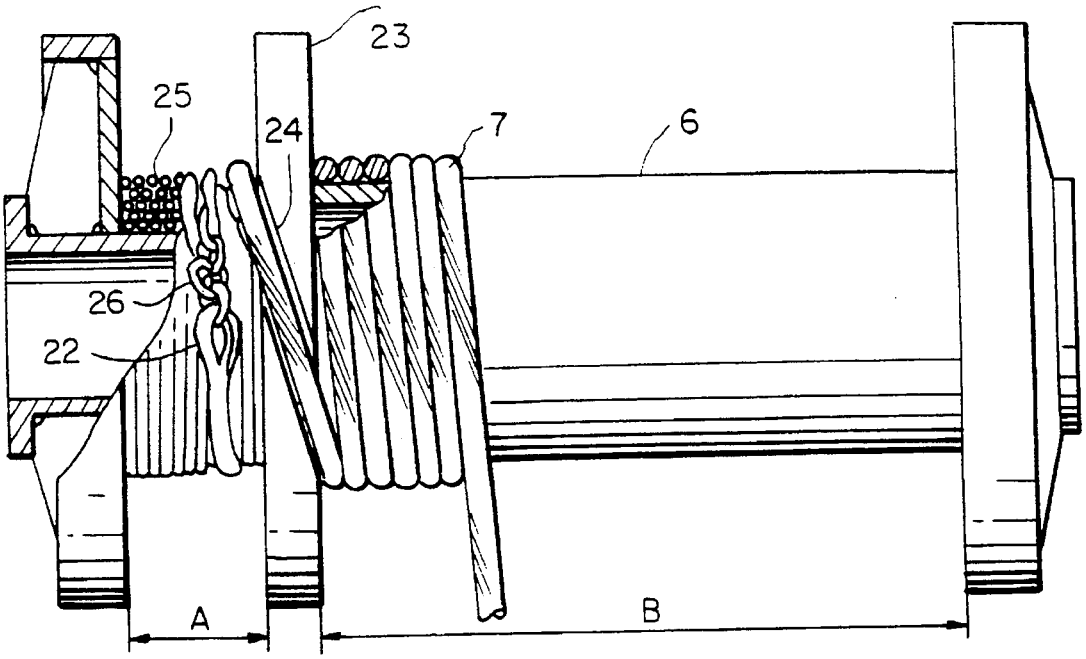
FIG. 4 is a front view in part cutaway of an improved kind of capstan drum for carrying the mooring wire rope.

As is to be seen from FIG. 4, capstans for mooring wire rope are provided with an improved kind of drum which is divided into two parts (an auxiliary part A and a principal part B), by means of a flange in the middle, 23, with a groove, 24, in it, to bear wire rope, 7, from one part to the other. The auxiliary part A holds less rope, has a hub which is smaller in diameter than that of the main part B, such difference in the gauge of the hub being meant to stow the extension rope, 25 (of smaller gauge) which is wound on this part until it grows to the same gauge as that of the hub of the main part B, thereby diminishing any risk of twisting.

Thus, after having been laid, the main rope, 7, shifts from the main part B to the auxiliary part A, where it is fastened to the extension rope, 25 (by means of a triple link, 26, and other conventional accessories, lying outside the main part B), which will lead loop 22 to the fastening platform. Because of all this, the shape of all stowage drums, 12, must be the same.

For an anchor laying system where the same are laid beforehand, standby buoys must first of all be dropped and moored, their job being to hold, at the surface, the end of the mooring line laid, or the end of a wire leading to the end of such line, until the platform arrives at the site.

Laying of the mooring means for such buoys is done in the same way as is decribed below for anchors, while choice as to quantity and types of buoys is dealt with further on.

Anchors are laid in pairs so as to lie opposite (approximately) to one another, as regards the mid-point (site) thereof, in order to enable line pulling tests to be carried out, which will also be dealt with further on.

Figure 5:
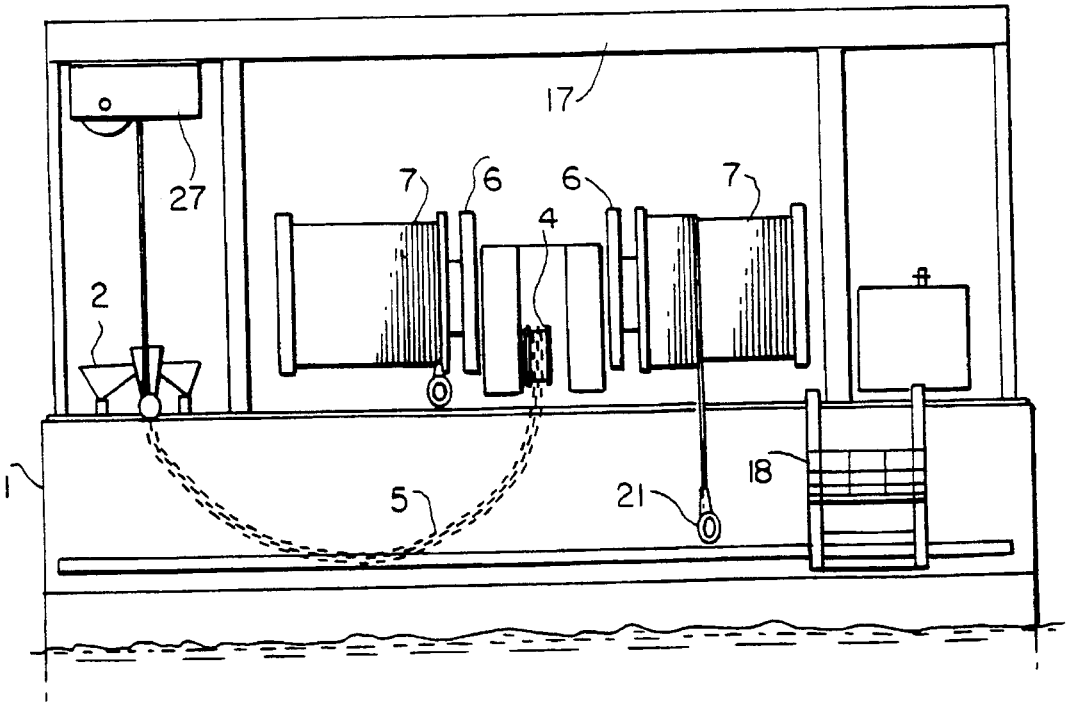
FIG. 5 is an rear view of the anchor-dropping craft in action.
Figure 6A:
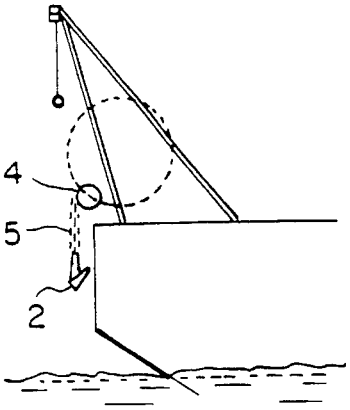
Figure 6B:
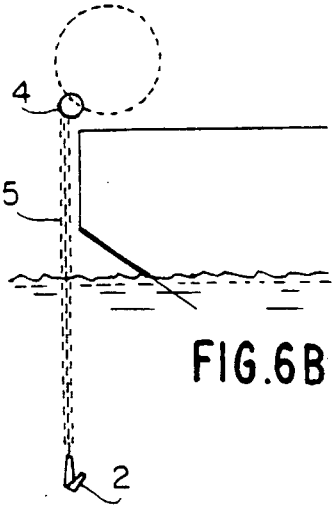
Figure 6C:
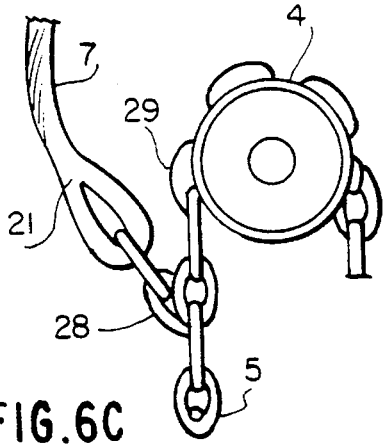

The way the anchors are laid in this invention is shown in FIGS. 5 and 12. As is to be seen from FIG. 5, anchor 2 is first of all shifted out of its well, already fastened to the end of chain 5, and brought in front of chain capstan 4 with the aid of block and tackle, 27. At this point the weight of anchor 2 is transferred to chain 5, and block and tackle 27 is released (FIG. 6A) and a start made on casting chain 5 overboard (FIG. 6B). The length of chain 5 to be dropped is not only measured by instruments but also visually when the special triple link 28 (FIG. 6C) gets to the edge of the fastening platform 18 (FIG. 5), whereupon loop 21 of wire rope 7 is fastened to it.

Figure 6D:
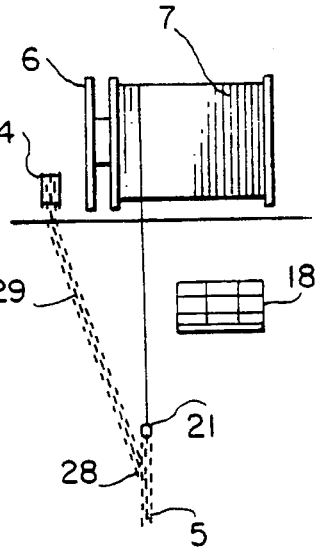
Figure 6H:
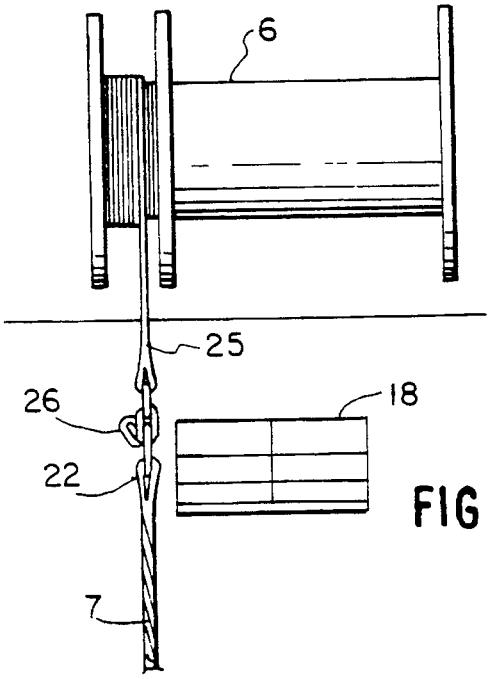
Figures 6G, 10:
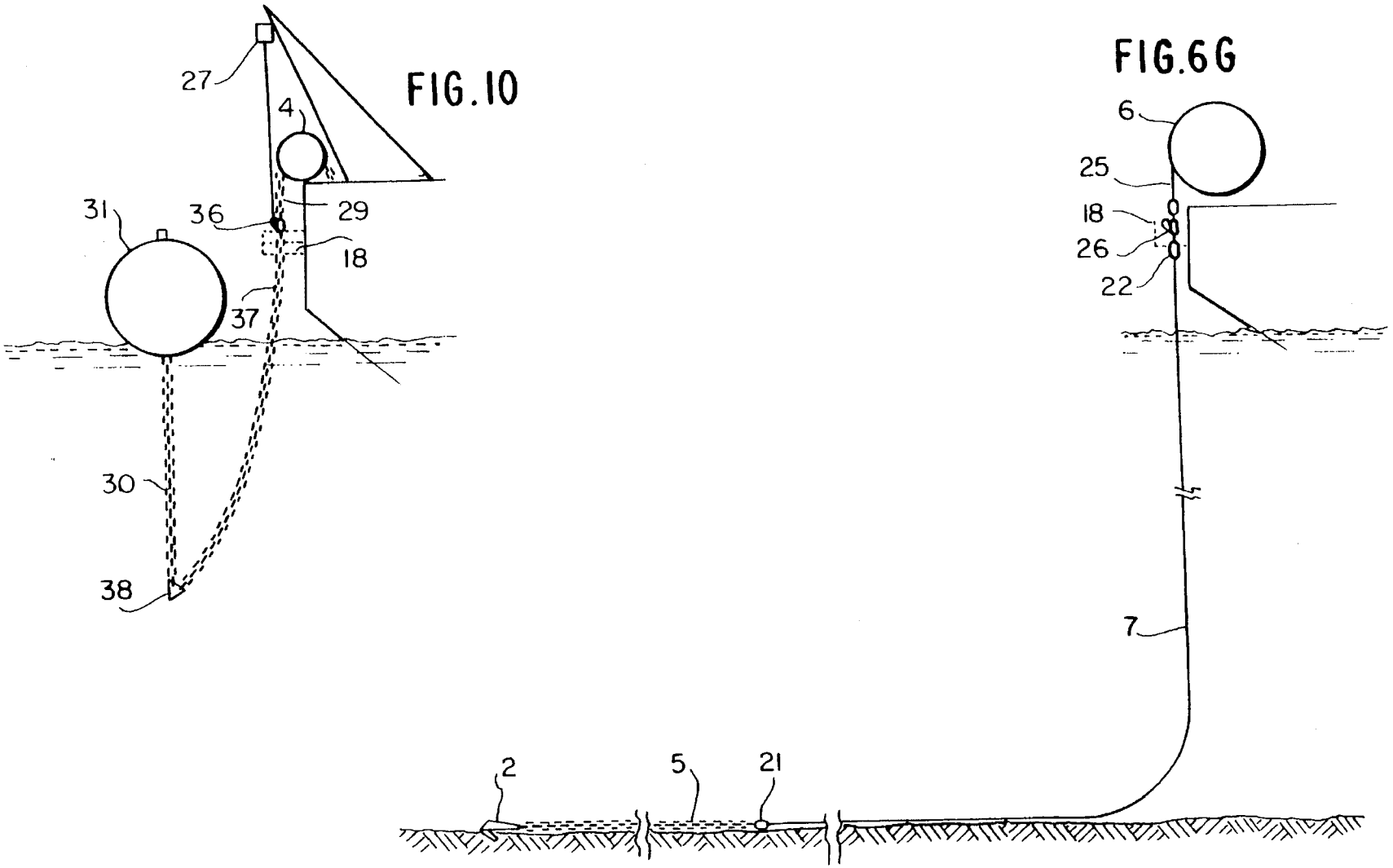
Figure 6E:
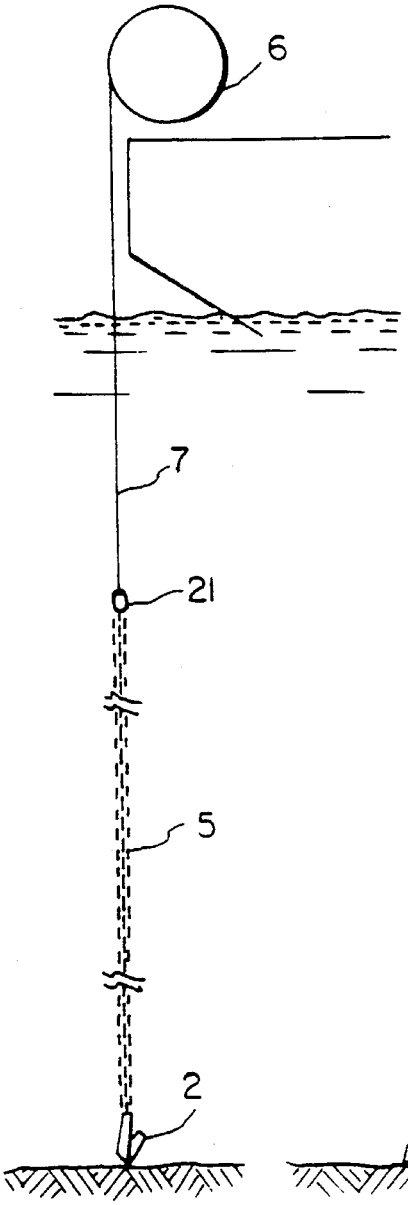
Figure 6F:
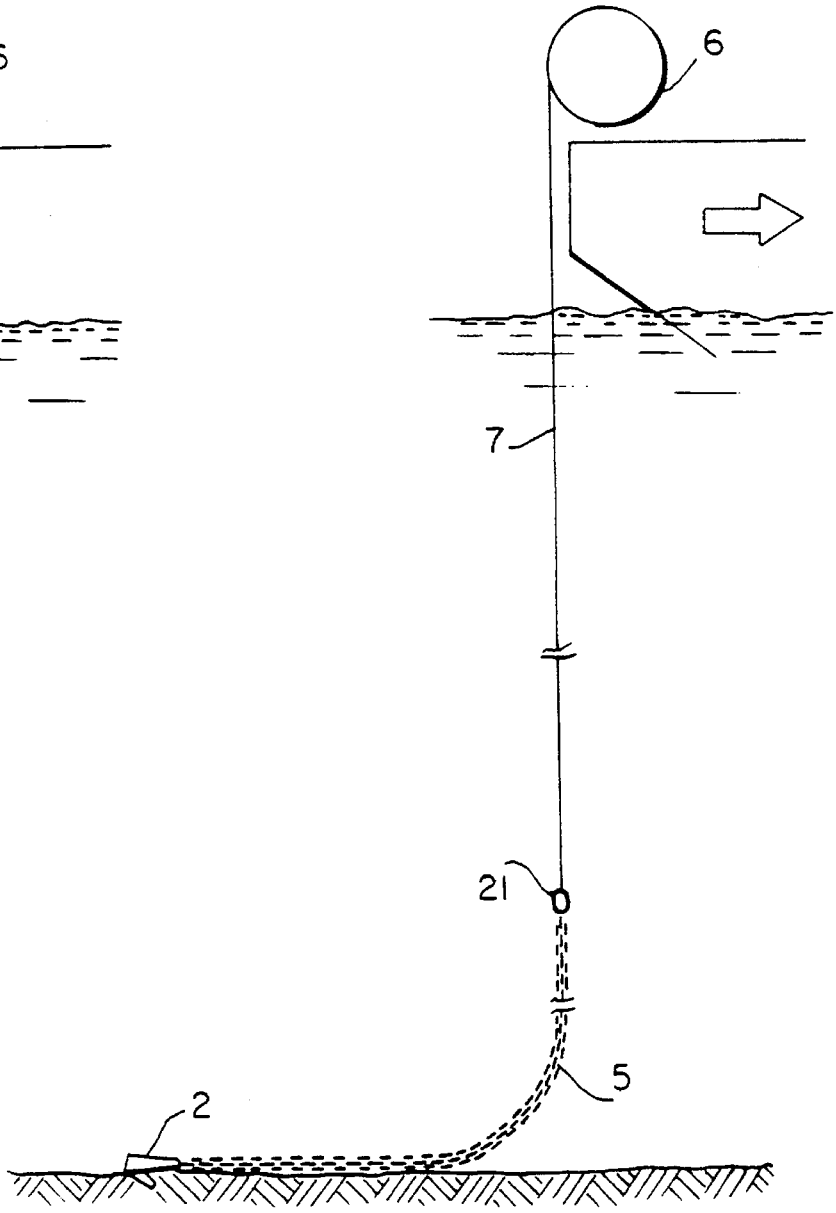

After wire rope 7 has been fastened to improved drum 6, an extra length of chain or extension 29 is cast in order to transfer the weight of chain 5 to wire rope 7 (FIG. 6D), and fastening is then hoisted (this time with the wire rope drum) up to platform 18 height, in order to release extension 29 from the chain. The continuous, wire rope 7 now being cast, total length of line already dropped (chain and rope) being controlled until anchor 2 gets to sea bed (FIG. 6E), whereupon; laying craft 1 should by lying over bearings agreed upon for the anchoring point. Then craft 1 travels (FIG. 6F) towards the desired position for the platform, while dropping and laying chain 5 and wire rope 7 to the bottom of the sea, until triple link 26 (FIGS. 6G–6H) is at platform 18 height ready to be fastened to the standby buoy.

Figure 7:
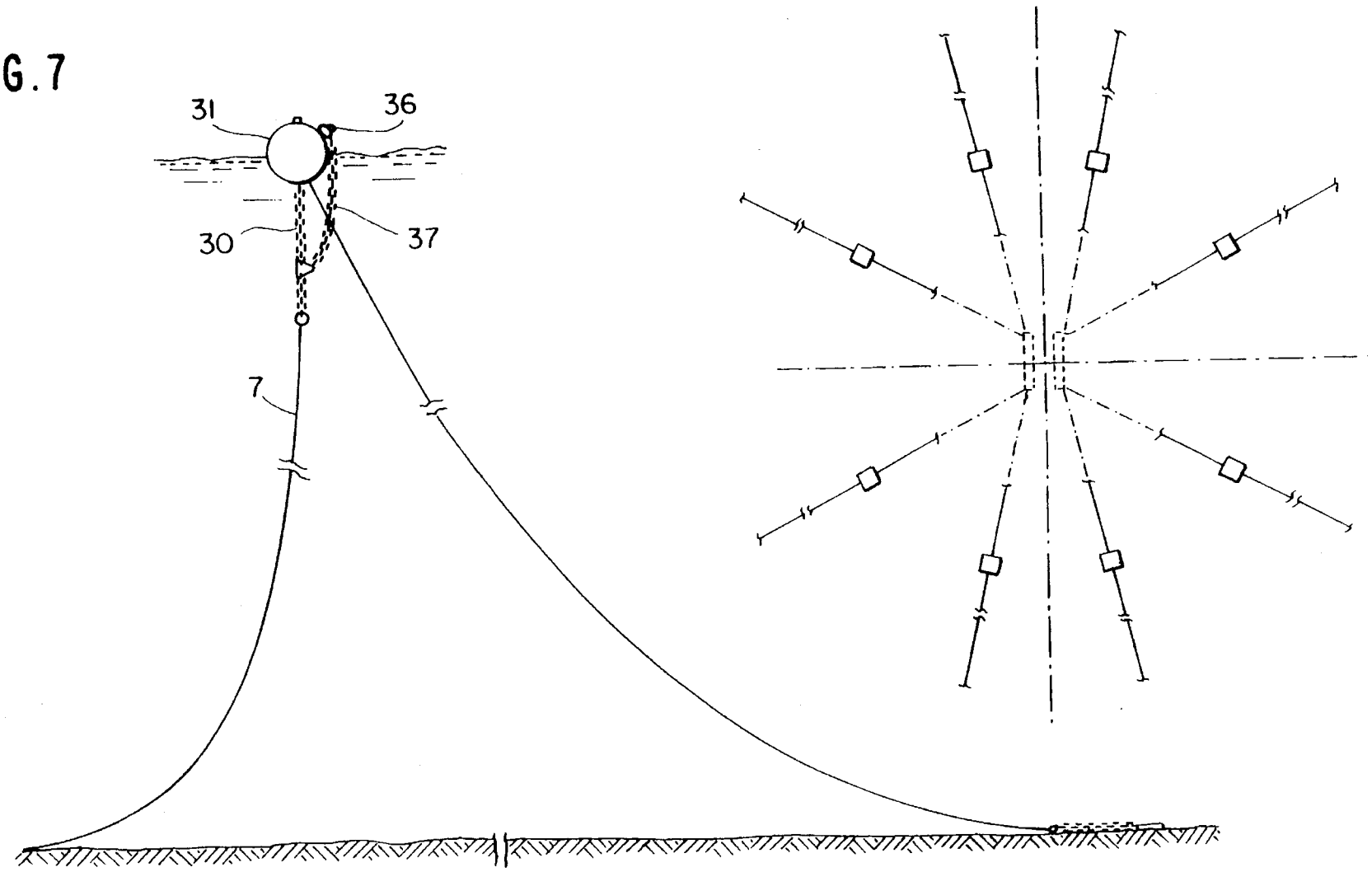
Figure 8:
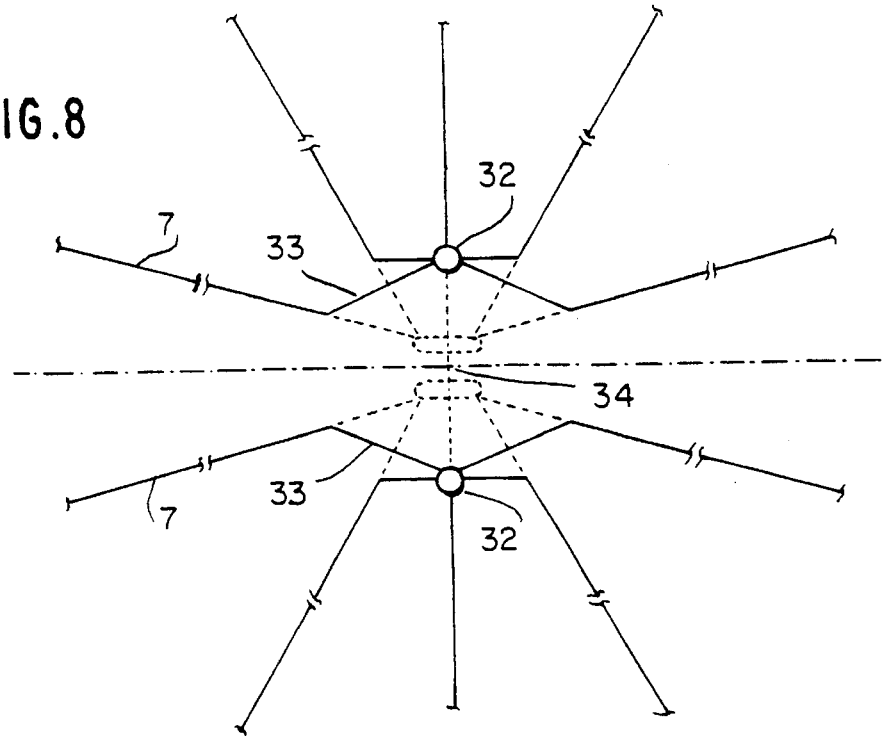

This fastening can be done in two ways. In the first, as shown in FIG. 7, wire rope 7 itself is fastened directly to rope 30 hanging from buoy, 31, (a high capacity independent buoy and installed beforehand in the laying route), and in the second, as shown in FIG. 8, wire rope 7 is laid, all of it, at the bottom of the sea and fastened to a buoy, 32, which is a joint buoy, by means of a smaller diameter, therefore lighter, hanging rope, 33.

In this second way all the hanging ropes, 33, for anchors on one side of the platform can be fastened to a buoy, 32 (in such instances, put in beforehand beyond the route of the mooring lines), which can also be used as markers when bringing platform into place. Fastening 34, between the two buoys, 32, is carried out after dropping work has been done, so as not to affect pulling tests, and is withdrawn after platform has been moored to site.

Figure 9:
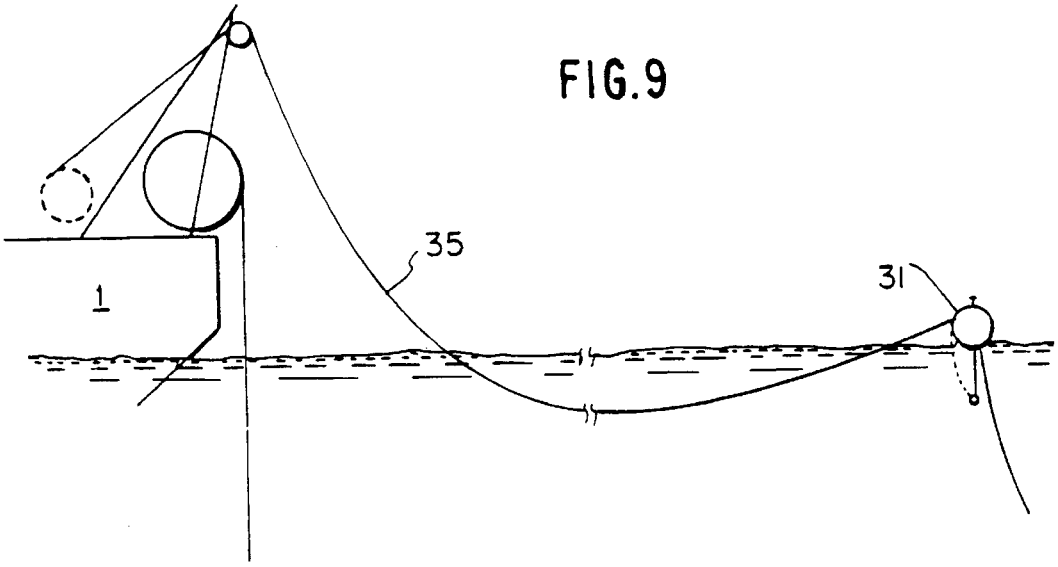

After wire rope has been laid the craft 1 will be a certain distance away from the standby buoy, as is shown in FIG. 9.

Buoy 31 is brought close to laying craft, 1, rope 35 is pulled by means of the auxiliary capstan, then fastened to the buoy with the help of the tug, where, once buoy 31 has been reached it is moored to craft 1, the auxiliary windlass being released. Then, with the aid of an auxiliary capstan, or a block and tackle, 37 (FIG. 10), triple link 36 of extension 37 (chain) of buoy 31 hanging rope 30 is brought to the level of operating platform, 18, extension 29 of the chain being fastened so as, with the aid of windlass 4, to bring plate 38 of buoy hanging rope 30 up to the level of platform 18 and to fasten it to the triple link 26 of rope 7 (FIG. 11). The procedure is the same if a hanging rope is used (with the main rope laid at the bottom of the sea) for mooring to the buoy.

After fastening to the buoy has been done, the procedure of transfering weight and releasing extensions goes on until rope 7 is hanging from buoy 31 and extension 37 of the hanging rope is fastened to the buoy. The end of the laying operation is shown in FIG. 12.

After every pair of opposite lines have been laid the mooring test should be carried out, pulling with the laying craft winches, one line against the other, at a preset force. The test is done by mooring the first line of the pair directly on to the standby buoy, while the second line is being laid. When the second line has been laid, its end is fastened to a rope of the same gauge and length (second drum) and the operation goes on, as described, this other rope now being laid bound for the first line standby buoy. Upon being reached, the first line is fastened to the chain extension of the winch, and buoy released.

The craft 1 now goes back picking up the rope and laying the chain until it comes to a point fixed upon beforehand. The chain is locked and a first pull made with the rope capstan drawing on the second line. A brake is then applied to the winch drum and a second line is pulled, with the first line capstan, until set force is achieved, which state is kept up for the time required under the test.

To end the test, the pull in the lines is eased, first of all lines by slacking the chain (to diminish pull) and then slacking the rope. The next step starts off with picking up the chain while at the same time laying the wire rope (again), up to the end of the first line, then the chain is unfastened and rope is tied directly on to the buoy (or by means of a hanging rope). Afterwards the craft 1 starts picking up the auxiliary rope until it gets to the end of the second line and it is tied to its standby buoy.

Figure 13C:
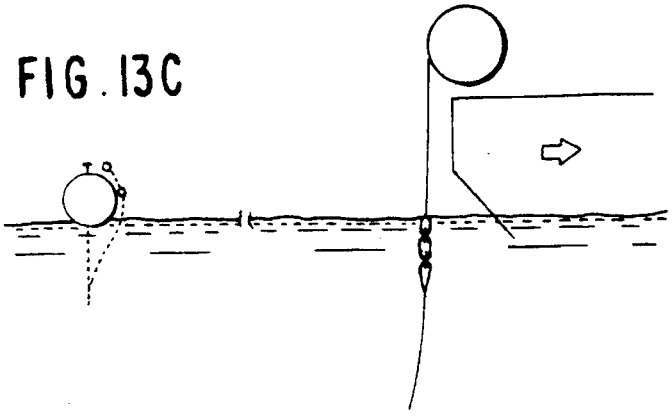
Figure 13D:
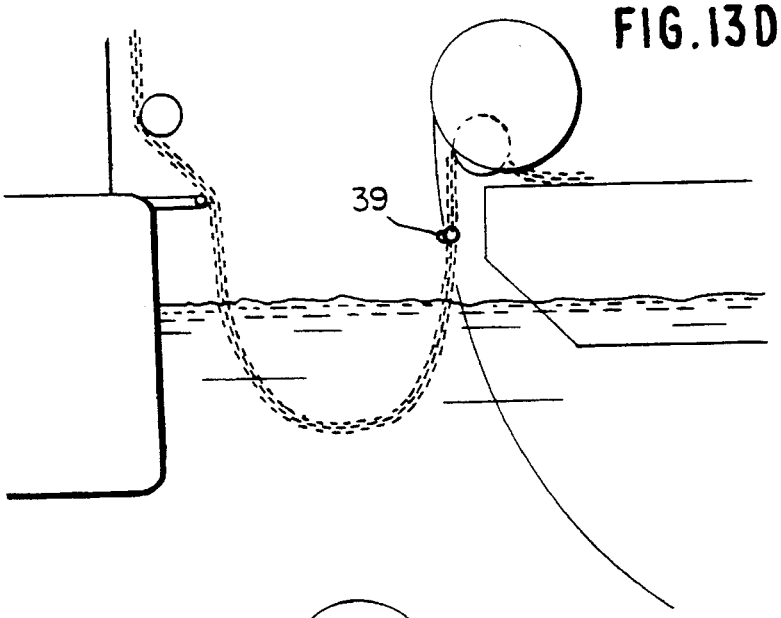
Figure 13E:
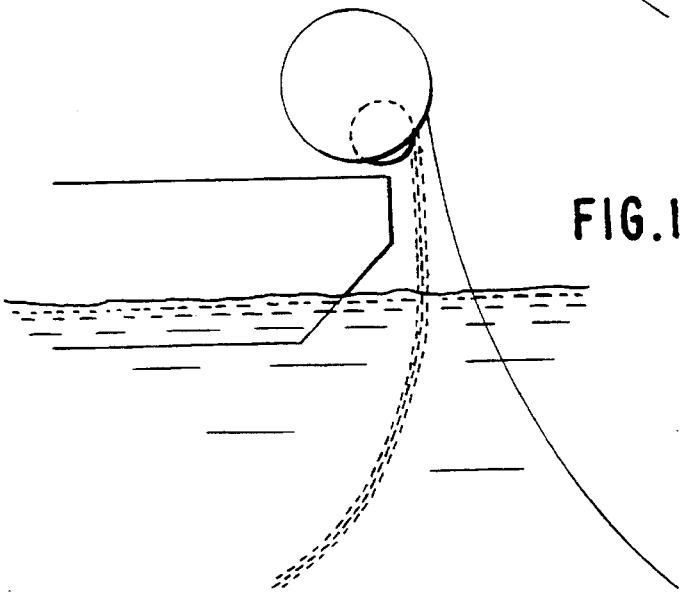
Figure 13F:
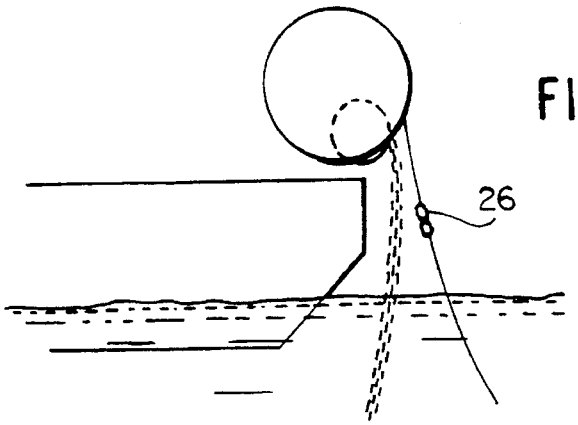

The platform mooring procedure, of this, is shown in FIGS. 13A–13H. First of all, the laying craft 1 picks up the line that is to be dealt with, at the standby buoy (FIG. 13A), with the aid of the chain capstan, and fastens the auxiliary rope to it (FIG. 13B). The craft 1 moves off bound for the platform, while laying an auxiliary rope (FIG. 13C), and taking on, close to the platform, the end of the second part of the chain thereof, which is fastened to the laying craft chain; a triple link 39 (FIG. 13D) being introduced where the two chains meet. After such fastening length of chain available at the platform is dropped, the craft 1, at the same time begins to pick up the auxiliary rope laid, up to where this rope meets the line at working platform, 18, level, whereupon the drum is locked (FIGS. 13E and 13F).

If the chain length is very little, more pull will have to be exerted upon the auxiliary rope to get to the meeting point.

Figure 13G:
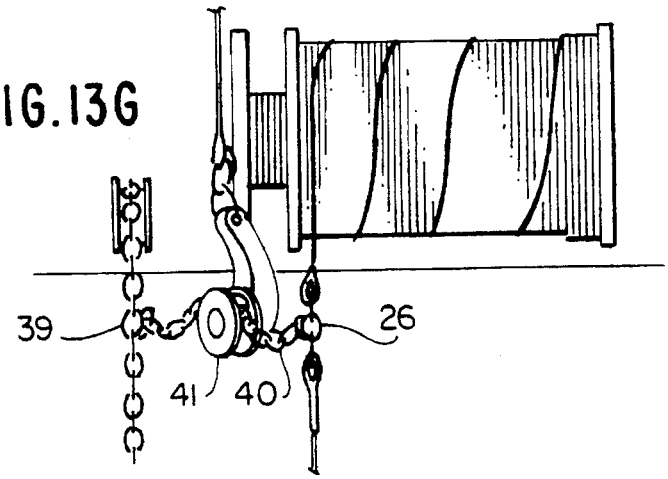
Figure 13H:
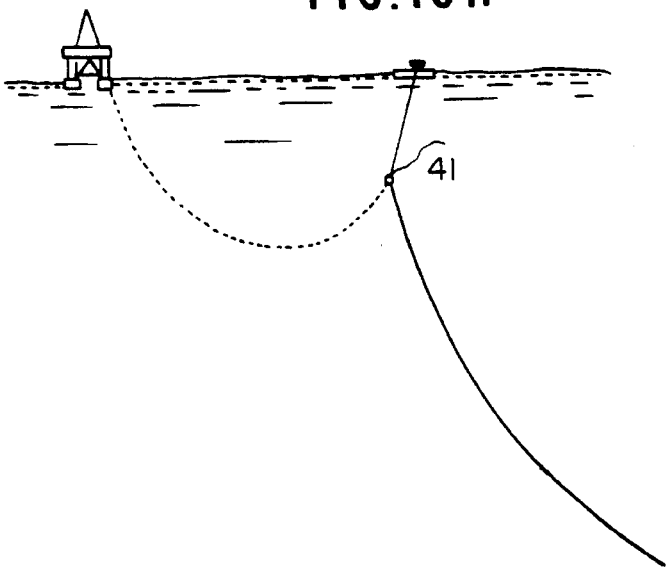

With regard to the step shown in FIG. 13G, where triple links 39 and 26 of chain and wire rope, respectively, lie more or less at same level, the two are fastened together with the aid of a small length of chain, 40, together with a laying device, 41, held up by block and tackle or other means known to those in the business, meant to help in the lowering of the fastened line, until it gets down to its point in the line sag (FIG. 13H). To do this, once fastenings have been made, weights of chain and rope are transferred to laying device, 41, triple links, 39 and 26, are withdrawn from the craft chain and the auxiliary rope, the latter being fastened to the laying device, 41, which is released from the means that holds it up, weight being transferred to the auxiliary rope.

Line is lowered until it reaches its spot in the sag and the laying device, 41, is recovered.

In the lowering this device prevents any slipping and/or fall of the line which, owing to its weight, might mean a jerk that could seriously damage the platform and its capstan. However, this work cannot be done with the aid of any of the chasers to be had on the market since they have no kind of locking arrangement to prevent any slipping of the line held up thereby.

Figure 14A:
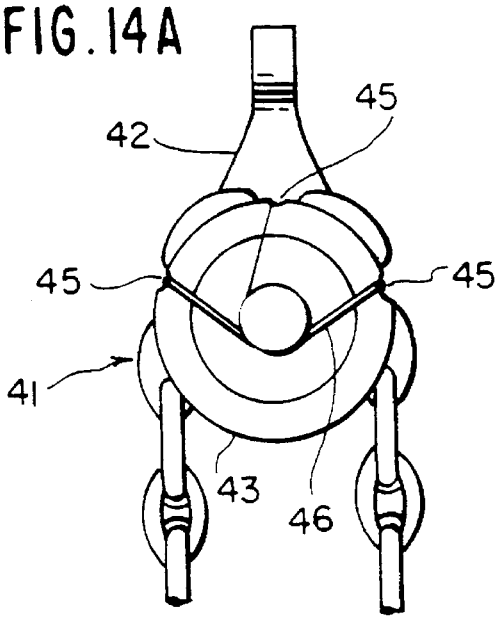
FIGS. 14A–14B are front and side views, respectively, of the improved dropping device used for the platform mooring system.
Figure 14B:
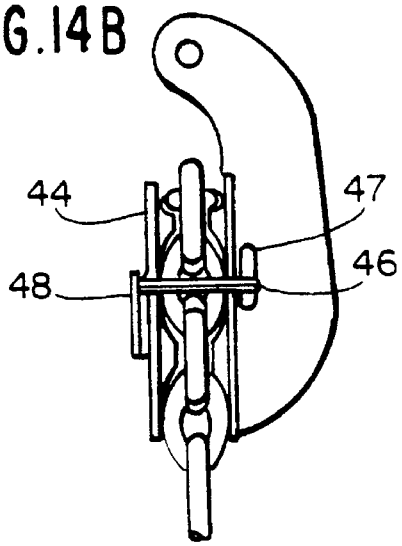

FIGS. 14A and 14B provide details of the improved laying device, 41, forming a part of this invention, as referred to in FIG. 13G, and specially meant for this operation. The device consists of a bearing base, 42, a sheave crown, 43, which fits in bearing base, 42, by means of spindle, 44. In the flanges in the sides of crown 43 there are slots, 45, that act as guides for fusible ropes, 46 (two of them), which are fixed in the following way: at one end, to a common lug, 47, in the middle, kept off by a guide, 48, mounted on spindle, 44, and at the other end, to individual turnbuckles that enable links of chain to be tied to crown, 43, at different angles. Thus, as line is lowered to its point in the sag, the chain wrapped around the crown, 43, tends to spread out, links at the topmost side of the sag shifting away from it first of all. The size of the fusible ropes is such as to ensure that the chain is held, but is unable to withstand the weight of the line when the held link begins to shift away from the crown. Thus, when the last fusible rope bursts, the line will have practically reached its point in the sag and any sliding or slipping of the improved laying device, 41, will not harm the platform or capstan.

Figure 16:
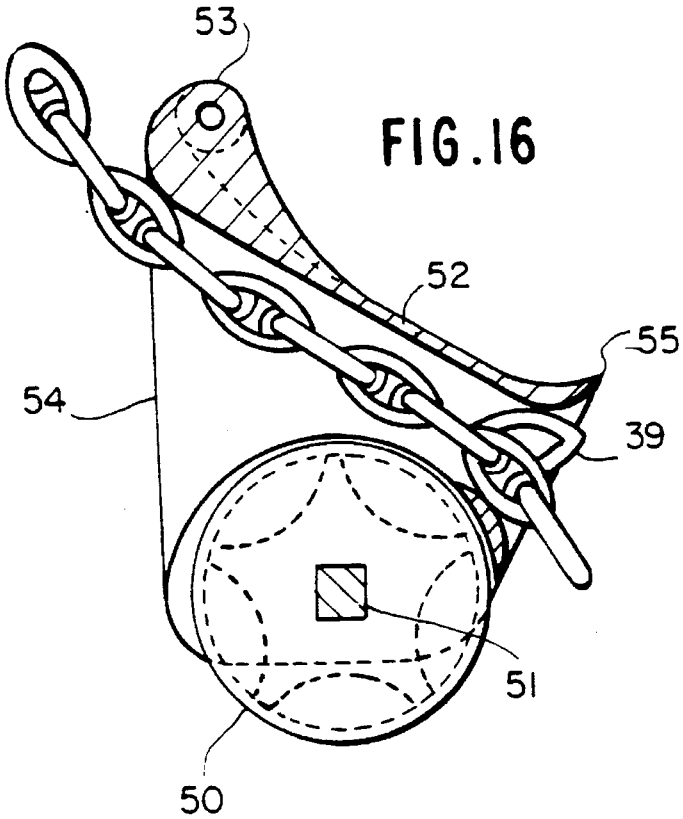
FIG. 16 is a part sectional view of the line fishing tool shown in FIG. 15.
Figure 15:
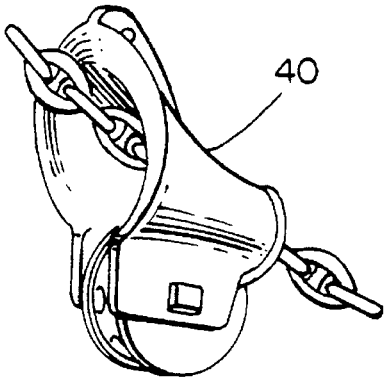
FIG. 15 is a perspective view of the improved line fishing tool used for the platform mooring system.

Whenever any part of a mooring line undergoes regular checking or replacement, conventional procedure requires the anchor to be displaced, this being done with the aid of an anchor chaser, after which, from the platform, whatever required length of line is pulled in. Such work calls for a high-power tug, particularly to relay the line afterwards, and there are several disadvantages, the more so if ropes have to be changed.

Where lines are laid beforehand as in the system followed in this invention, the same work can be done with laying device 1 in a simpler way, by hoisting up on a line where the second part of the platform chain joins the wire rope (middle part of line), for which an improved line chaser, 49, shown in FIGS. 15 and 16, is used. The line is untied at such point, and the chain is released and hauled up on to the platform, while the part, laid beforehand, is picked up by the laying craft. Any change of line parts, including platform chain (second part) can be done successively with the chain stowed on board the laying craft.

The line fisher, 49, FIG. 16, consists of a sheave and crown (50) held in place by a spindle (51) which pierces the body (52) of the chaser, there being in the upper half of the chaser, a hoisting eye (53) in the reenforced part thereof, in the shape of an inverted groove which slides over the chain, a flared front part (54) which acts as a guide, and a nozzleshaped back part (55) through which only one link at a time of the chain can pass.

As shown in FIG. 17, such improved line fisher, 49, is fitted into the platform chain (second part), below fenders (56), lying at platform float height, and fastened to the platform by means of a hanging rope, 57.

Figure 18C:
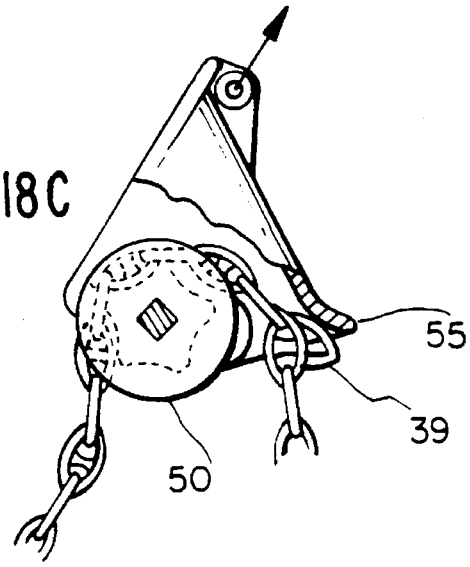
Figure 18D:
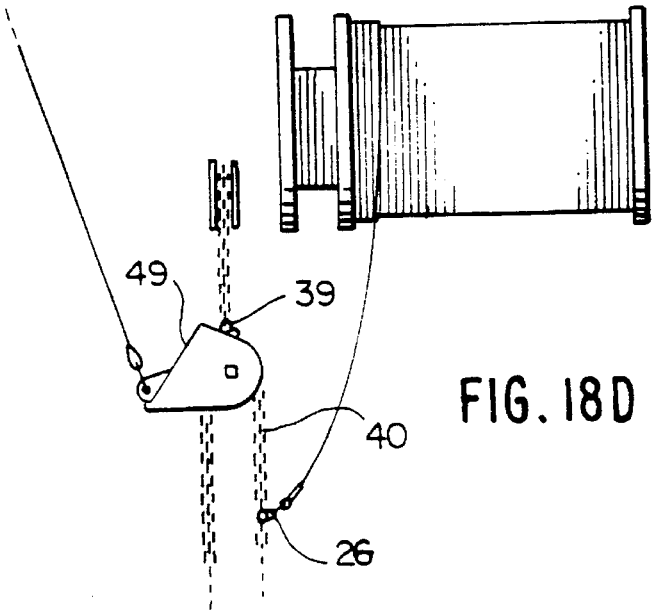

To use the line fisher 49, the hanging rope, 57, is delivered (with the aid of a crane) to the laying craft lying close to the platform, on which it is fastened to the wire rope of the main drum of its capstan, and with which it is lowered until it gets to the meeting point. As fisher, 49, is lowered, the laying craft is shifted along the route of the line, so as to keep the rope more or less vertically over fisher, 49. When nozzle, 55, gets to the first triple link, 39 (FIG. 18A) of the fastening, fisher will be in place for hoisting. Craft 1 should continue to travel along its route and reach a position where it is able to pull fisher, 49, towards the lowest side of the sag (FIG. 18B), whereupon the groove will lift and the chain will wrap around and fit into sheave crown, 50, as line is being hoisted (FIG. 18C).

Upon reaching the surface, the triple link, 39, is fastened to the chain (or extension) of the laying craft, the weight of line being transferred to the craft. Fisher, 49, is fastened directly on to block and tackle or other means of holding it. The rope of the fisher 49 is unfastened and tied to the triple link, 26, where chain part, 40, joins the wire rope laid beforehand (FIG. 18C). Then part 40 of the chain is unfastened and put onto the craft 1 and, where procedure opposite to that described above is concerned, to fasten the line laid beforehand, to the platform, it is returned to the end of the chain togegher with chaser, on to the platform. The craft 1 then picks up the rope 7 laid, while getting closer to the platform, fastens and transfers the end of the rope 7 laid beforehand that is to be recovered, to the extension rope of the 2nd main drum (then empty), so as to start recovery work. All work after this is a repetition of what has already been described above, including lowering of the line already fastened to the platform, down to the level of the sag, at the end of the operation.

Though this invention has been described in terms of a preferred version thereof, experts in the field concerned will have noticed that several variations or modifications of the invention are possible, and it is understood that any such variations are to be regarded as covered by this invention.

I claim:

1. A method of anchoring a floating platform at a predetermined anchoring site by an anchor-laying craft;

said anchor-laying craft including a working platform for supporting thereon anchors, wells for the anchors, first lengths of chain, winches for wire rope, a chain capstan, drums stowing wire rope wrapped thereabout, standby buoys, a laying device, and block and tackle;

said floating platform supporting second lengths of chain having one end thereof for fastening to respective mooring lines set by said anchoring-laying craft;

said method comprising the steps of:

1) placing the anchor-laying craft at a predetermined position remote from the predetermined anchoring site of said floating platform where an anchor is to be set at the sea bottom;

2) connecting one of said anchors to a first length of chain, bringing the anchor to a position in front of said chain capstan at the level of said working platform via said block and tackle, and paying out said first length of chain via said chain capstan with said anchor coupled thereto until another end of said first length of chain fitted with a first triple link appears at the level of the working platform;

3) connecting a spliced eye of said wire rope to said first triple link of said first length of chain at an end remote from the connection of the chain to said anchor, paying out the wire rope to control the total length of the mooring line until the anchor reaches the sea bottom;

4) with the anchor set at the sea bottom, moving the laying craft in the direction of the predetermined anchoring site of the floating platform while paying out said first length of chain plus wire rope on the sea bottom, until the other end of said wire rope with a second triple link appears at the level of the working platform;

5) disconnecting said wire rope from said laying craft and fastening said other end of said wire rope directly to a pendant chain of a standby buoy by means of said second triple link;

6) repeating steps 1) through 5) until all of the wire ropes which comprise the mooring lines are connected to at least one standby buoy at said site;

7) bringing the floating platform to the predetermined platform anchoring site defined by said at least one standby buoy;

8) liberating the at least one standby buoy and its respective pendant chain; and completing the mooring of the floating platform by fastening a second length of chain on board said floating platform to a respective mooring line, and 9) lowering the mooring line to the extent of normal sag of the mooring line by means of the laying device via said anchor-laying craft.

2. A method of anchoring a floating platform as claimed in claim 1, wherein each mooring line includes a second triple link which is coupled to an end of the wire rope remote from the end of the wire rope connected to the first length of chain coupled to the anchor, and wherein said step of fastening said mooring line to a standby buoy, comprises fastening of the second triple link directly to a pendant chain of the standby buoy.

3. A method of anchoring a floating platform at a predetermined platform anchoring site, performed by an anchor-laying craft, said method comprising:

sequentially recovering via said anchor-laying craft a plurality of standby buoys in the vicinity of the predetermined anchoring site of the floating platform, each standby buoy holding a mooring line comprising an anchor, a first length of chain coupled at one end to the anchor, a wire rope having one end coupled to an opposite end of said first length of chain, and a first triple link connected between an opposite end of said wire rope and a pendent chain connected to said standby buoy, removing said mooring line from said buoy by use of a chain capstan on said anchor-laying craft and fastening an auxiliary wire rope carried by the anchor-laying craft to said first triple link of said mooring line;

shifting said anchor-laying craft towards said floating platform while laying said auxiliary wire rope and picking up close to the floating platform, a free end of a second length of chain connected at an opposite end to said floating platform and coupling said second length of chain to a third length of chain of said anchor-laying craft by a second triple link;

pulling in the auxiliary wire rope with a winch on the anchor-laying craft until said first triple link at the coupling between the auxiliary wire rope and the mooring line rises to the level of the working platform of the anchor-laying craft and then stopping the winch for the auxiliary wire rope on the anchor-laying craft;

fastening said second triple link at the connection between the second length of chain of said floating platform and the third length of chain connected to the anchor-laying craft to the first triple link at the end of the mooring line held by the auxiliary wire rope by means of a small length of chain fitted on a laying device held by a block and tackle on the anchor-laying craft and transferring the weight of the mooring line to the block and tackle;

unfastening the third length of chain of the anchor-laying craft from said second triple link connected to the second length of chain of the floating platform, and unfastening the auxiliary wire rope from the first triple link at the end of the mooring line and connecting said auxiliary wire rope to the laying device, releasing said laying device from said block and tackle, and lowering with the auxiliary wire rope the laying device with the mooring line connected to the second length of chain of the floating platform to a sea depth corresponding to the level of normal sag of said mooring line, and recovering the laying device after release of said small length of chain and said mooring line from said laying device; wherein said laying device consists of a bearing base, a sheave, a sheave crown fixed into said bearing case by means of a spindle, said sheave crown having spaced slots in a front flange thereof along a perimeter of the sheave crown, and wherein said method further comprises;

passing a fusible rope through said slots as guides and fixing said fusible rope to a common lug, deviated in the middle by a guide mounted on said spindle, thereby lying links of said small length of chain at different angles tightly to said sheave crown to prevent any risk for falling or slipping of the mooring line from said laying device during the lowering operation, and wherein the strength of said fusible ropes is calculated to keep said links of said small length of tied in position with respect to said laying device, until the mooring line sags when reaching close to the depth of its normal sag level, said links tied with said fusible tie rope then breaking away from the sheave crown, thereby releasing said small length of chain and consequently the mooring line from the laying device.

4. A method for regular inspection or replacement of an item of a mooring line for mooring an oil rig floating platform at a predetermined platform anchoring site, performed by an anchor-laying craft, said method comprising:

slidably mounting a line fisher on a length of chain connected at one end to said platform and attached at an opposite end to an auxiliary wire rope by a triple link;

said line fisher comprising a sheave, a sheave crown fixed by means of a spindle to a reinforced body in the shape of a channel having a front part with an enlarged opening to guide the chain through the channel, a lifting eye on top of the line fisher connected to the auxiliary wire rope, and a channel back part, constituting a guiding nozzle acting as a triple link stop, said guiding nozzle having an opening sized to allow only the passage of a single link of said chain;

lowering said line fisher along said chain whereby said chain passes through said guiding nozzle until said triple link engages said stop thereby positioning said line fisher at a desired hoisting point for recovering the mooring line;

moving said anchor laying craft away from said platform; and pulling in the auxiliary wire rope by a wire rope winch on said anchor-laying craft when said anchor laying craft is positioned beyond the hoisting point of the mooring line, opposite the floating platform.

* * * * *